US005627003A

United States Patent [19]

Laing et al.

[11] Patent Number: 5,627,003

[45] Date of Patent: May 6, 1997

[54] CLEANING PROCESSES

[75] Inventors: John R. Laing, Rochester; Don B. Jugle, Penfield, both of N.Y.

[73] Assignee: Xerox Corporation, Stamford, Conn.

[21] Appl. No.: 753,541

[22] Filed: Sep. 3, 1991

[51] Int. Cl.[6] ..... G03G 9/08

[52] U.S. Cl. ..... 430/125

[58] Field of Search ..... 430/125

[56] References Cited

U.S. PATENT DOCUMENTS

| | | | |
|---|---|---|---|
| 4,298,672 | 11/1981 | Lu | 430/108 |
| 4,338,390 | 7/1982 | Lu | 430/106 |
| 4,558,108 | 12/1985 | Alexandra et al. | 526/340 |
| 4,883,736 | 11/1989 | Hoffend et al. | 430/110 |
| 4,912,005 | 3/1990 | Goodman et al. | 430/108 |
| 4,937,157 | 6/1990 | Haack et al. | 430/110 |
| 5,003,354 | 3/1991 | Takamiya et al. | 430/125 X |
| 5,103,266 | 4/1992 | Miyamoto et al. | 430/125 X |

*Primary Examiner*—Marion E. McCamish
*Attorney, Agent, or Firm*—E. O. Palazzo

[57] ABSTRACT

A process for cleaning imaging members which comprises applying thereto subsequent to the formation and development of images a composition comprised of resin particles, carbon black particles, magnetite, charge additive, or a mixture of charge additives, and a wax component comprised of polymeric alcohols of the formula $$CH_3(CH_2)_nCH_2OH$$

wherein n is a number of from about 30 to about 300, and thereafter removing said composition.

14 Claims, No Drawings

CLEANING PROCESSES

BACKGROUND OF THE INVENTION

This invention is generally directed to processes, and more specifically the present invention is directed to cleaning processes. In one embodiment of the present invention, there is provided a process for cleaning, or removing undesirable debris from imaging members by applying thereto a composition comprised of a styrene butadiene resin, carbon black, magnetite, a polymeric hydroxy compound, or waxes with hydroxyl functionality and a charge control additive. With the process of the present invention there is, for example, enabled the effective removal of magnetite and compositions, such as toners, containing magnetite from layered imaging members. Moreover, the process of the present invention enable the photoconductive imaging member present in an imaging apparatus to function for extended time periods, for example up to 70,000 cycles while simultaneously preventing the localized accumulation of undesirable toner debris thereon which can encompass sufficient areas of the photoconductive members to permit unwanted toner spots to be present on the final developed output copy.

The failure to remove the aforementioned magnetites from layered photoconductive imaging members can result in the formation on the member of an undesirable semi-opaque film, which film can increase the voltage in the background areas of the imaging member, which in turn can increase the amount of toner deposited in non-image areas. This can result in increased copy background and decreased toner yield. Also, the presence of debris particles on the layered imaging member in electrostatic imaging systems can cause undesirable copy quality defects, such as spotting. In embodiments with the process of the present invention, the wax in the toner being applied to the imaging member can capture the magnetite debris particles, which particles can be desirably transported with the toner particles onto the developed copy, into the toner waste sump, and the like.

Cleaning of imaging members with, for example, blades is known. Also known are the cleaning of photoconductive imaging members with brushes. Disadvantages associated with these processes of cleaning include their inability to remove small, for example with a particle size of less than 5 microns, and more specifically from submicron, about 0.01 to 0.9 micron, magnetite rich particles comprised, for example, of toner resin, magnetite, for example from between about 15 and 100 percent magnetite, such as MAPICO BLACK®, pigment particles, charge additives, and the like, from the imaging member. These and other advantges are accomplished with the toner and processes of the present invention.

Developer and toner compositions with certain waxes therein are known. For example, there are disclosed in U.K. Patent Publication 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates, such as papers, wherein there are selected toner compositions containing specific external lubricants including various waxes, see column 5, lines 32 to 45, which waxes are substantially different in their properties and characteristics than the polymeric alcohol waxes selected for the toner and developer compositions of the present invention; and moreover, the toner compositions of the present invention with the aforementioned polymeric alcohol additives possess advantages such as elimination of toner spotting not achievable with the toner and developer compositions of the '275 patent.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014; 4,394,430, and 4,937,157, the disclosures of which are totally incorporated herein by reference.

SUMMARY OF THE INVENTION

It is an object of the present invention to provide cleaning processes which possess many of the advantages illustrated herein.

Another object of the present invention resides in the provision of a toner and developer composition with stable triboelectrical characteristics for extended time periods.

In another object of the present invention there are provided toner and developer compositions with rapid admix, for example less than about 15 seconds, and minimal relative humidity sensitivity.

In another object of the present invention there are provided toner and developer compositions that can be selected for the cleaning of layered imaging members.

Moreover, another object of the present invention relates to a process for the removal of magnetite rich particles from known layered photoconductive imaging members.

These and other objects of the present invention can be accomplished by a process which comprises applying to an imaging member a certain toner composition comprised of resin particles, pigment particles, charge additives, and certain waxes. More specifically, the present invention is directed to a process for the removal of magnetite rich particles, and other undesirable debris, such as submicron size particles generated from paper, abrasion of the imaging member, and the like, from photoconductive imaging members by applying thereto a toner composition comprised of styrene resin particles, carbon black, magnetite, charge additive, and waxes with hydroxyl functionality, which waxes are available from Petrolite Corporation.

In one embodiment the present invention is directed to a cleaning process which comprises initially preparing a toner by known means such as the melt blending in a Banbury or extruder of resin, pigment, magnetite, and charge control additive, or a mixture of charge control additives, followed by mechanical attrition, thereafter adding thereto a waxy substance like UNILIN® available from Petrolite Corporation, and disclosed in U.S. Pat. No. 4,883,736, the disclosure of which is totally incorporated herein by reference, forming a developer by the blending of the formed toner with carrier particles, subsequently adding the developer to the development housing of a xerographic imaging apparatus, such as the Xerox Corporation 5090®, transporting the developer across the layered photoconductive imaging member present in the apparatus and thereby developing the latent image thereon, transferring the developed image to a substrate such as paper, and removing any untransferred toner particles with debris by the toner with wax and a cleaning system, such as a brush cleaner. Examination of the imaging member after developing images with a toner containing the wax, and with a toner containing no wax indicated that with the waxy toner the aforementoned undesirable particles, and debris were removed from the imaging member since, for example, no film was detected by visual observation and by a densitometer, while with the toner containg no wax a film was observed. A scanning electron microscope was also utilized to determine the absence or presence of particles on the imaging member.

The toner resin contains a known styrene butadiene, such as the PLIOTONES® available from Goodyear Chemical Company, with a high, for example from between about 70 to about 95, and preferably from between about 80 to about 90 weight percent of styrene. Examples of useful styrene butadiene copolymers include those prepared by a suspension polymerization process, reference U.S. Pat. No. 4,558,108, the disclosure of which is totally incorporated herein by reference; and mixtures thereof.

Numerous well known suitable carbon black pigments can be selected for the cleaning toner, such as REGAL 330®, VULCAN® carbon black, and BLACK PEARLS L®. Generally, the carbon particles are present in effective amounts of from between about 1 percent by weight to about 20 percent by weight, and preferably from between about 2 to about 15 weight percent based on the total weight of the toner composition.

Magnetites in effective amounts of, for example, from between about 25 to about 80 percent for the cleaning toner include those commercially available such as MAPICO BLACK®, MO4232, Northern Pigments magnetite, and the like, reference for example a number of U.S. patents, such as U.S. Pat. No. 4,560,635, the disclosure of which is totally incorporated herein by reference, and the like.

Illustrative examples of charge enhancing additives present in various effective amounts, such as for example from between about 0.1 to about 20, and preferably from between about 0.2 to about 5 percent by weight, include quaternary ammonium halides, such as alkyl pyridinium halides like cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; quaternary ammonium bisulfates, such as distearyl dimethyl ammonium bisulfate, reference U.S. Pat. No. 4,937,157, the disclosure of which is totally incorporated herein by reference; mixtures thereof and other known similar charge enhancing additives.

With further respect to the cleaning toner of the present invention, an important component present is a linear polymeric alcohol comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in one embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner illustrated herein in various effective amounts, and can be added as uniformly dispersed internal, or as finely divided uniformly dispersed external additives. More specifically, the polymeric alcohols are present in an amount of from between about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. In contrast, when the polymeric alcohols are present as external additives, the toner composition is initially formulated comprised of, for example, resin particles and pigment particles; and subsequently there are added thereto finely divided polymeric hydroxy compounds. These compounds known as UNILINS® are available from Petrolite Corporation.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Examples of specific carrier particles selected can be comprised of a magnetic, such as steel, core with a polymeric coating thereover, several of which are illustrated, for example, in U.S. Ser. No. 751,922 (abandoned) relating to developer compositions with certain carrier particles, the disclosure of which is totally incorporated herein by reference. More specifically, there are illustrated in the aforementioned application carrier particles comprised of a core with a coating thereover of vinyl polymers, or vinyl homopolymers. Examples of specific carriers illustrated in the aforementioned patent application, and useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a double polymer coating thereover, reference U.S. Pat. Nos. 4,937,166 and 4,935,326, the disclosures of which are totally incorporated herein by reference. More specifically, there are disclosed in these patents carrier particles with substantially stable conductivity parameters and with a polymeric overcoating mixture prepared by a process which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000, and preferably about 100 microns.

The toner compositions of the present invention can be prepared by a number of known methods, including mechanical blending and melt blending the toner resin particles, carbon black particles, magnetite, charge additive, and wherein the polymeric alcohol is present on the toner surface followed by mechanical attrition and optional classification, followed by blending with known external additives in effective amounts, such as from about 0.1 to about 3 weight percent, of colloidal silicas, like AEROSIL R972®, metal salts of fatty acids, like zinc stearate, and the like. Other methods include those well known in the art such as spray drying, mechanical dispersion, melt dispersion, extrusion, dispersion polymerization, and suspension polymerization. Toner particles with an average particle diameter of from between about 5 to about 25 microns can be selected.

Examples of layered photoresponsive imaging members that may be cleaned with the process of the present invention include those comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines vanadyl phthalocyanines, and titanyl phthalocyanine, while examples of charge transport layers include the aryl amines as disclosed in U.S. Pat. No. 4,265,990.

Moreover, the process of the present invention is particularly useful with electrostatographic imaging apparatuses containing a development zone situated between a charge transporting means and a metering charging means, which apparatus is illustrated in U.S. Pat. Nos. 4,394,429 and 4,368,970, the disclosures of which are totally incorporated herein by reference. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the present of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles, means for causing the flexible imaging means to move at a speed of from about 5 centimeters/second to about 50 centimeters/second, means for causing the transporting means to move at a speed of from about 6 centimeters/second to about 100 centimeters/second, the means for imaging and the means for transporting moving at different speeds; and the means for imaging and the means for transporting having a distance therebetween of from about 0.05 millimeter to about 1.5 millimeters. Also, the process of the present invention can be selected for cleaning the imaging member in the Xerox Corporation 5090® imaging apparatus wherein as the cleaning system there is utilized an electrostatic brush, which funtions similar to a magnetic brush cleaning device, reference for example U.S. Pat. No. 4,494,863, the disclosure of which is totally incorporated herein by reference.

Embodiments of the present invention include a process for cleaning imaging members which comprises applying thereto, subsequent to the formation and development of images, a composition comprised of resin particles, carbon black particles, magnetite, charge additive, or a mixture of charge additives and a wax component comprised of polymeric alcohols of the formula $$CH_3(CH_2)_nCH_2OH$$

wherein n is a number of from about 30 to about 300, and thereafter removing said composition.

The following examples are being submitted to further define various species of the present invention. These Examples are intended to illustrate and not limit the scope of the present invention. Also, parts and percentages are by weight unless otherwise indicated. Comparative information and Examples are also presented.

EXAMPLE I

There was prepared by melt blending, followed by mechanical attrition, a toner composition comprised of 80.2 percent by weight of styrene butadiene resin with 91 percent by weight of styrene and 9 percent by weight of butadiene copolymer resin particles (91/9), reference U.S. Pat. No. 4,558,108, the disclosure of which is totally incorporated herein by reference, 3.1 percent by weight of REGAL 330® carbon black, 16.4 percent by weight of MAPICO BLACK®, and 0.3 percent by weight of the charge enhancing additive distearyl dimethyl ammonium methyl sulfate. Subsequently, there was prepared a developer composition by admixing the aforementioned formulated toner composition, 3 parts by weight, with 97 parts by weight of carrier particles, which carrier was comprised of a steel core with a coating mixture, 0.70 percent by weight, thereover of polyvinylidene fluoride, 40 parts by weight, and 60 parts by weight of polymethylmethacrylate.

Thereafter, the formulated developer composition was incorporated into a Xerox Corporation 5090® imaging apparatus, or an electrostatographic imaging device containing an electrostatic brush cleaner with a toner transporting means, a toner metering charging means, and a development zone as illustrated in U.S. Pat. No. 4,394,429; and wherein the imaging member is comprised of an aluminum supporting substrate, a photogenerating layer of trigonal selenium, and a charge transport layer thereover of the aryl amine N,N'-diphenyl-N,N'-bis(3-methylphenyl) 1,1'-biphenyl-4,4'-diamine, 50 percent by weight, dispersed in 50 percent by weight of the polycarbonate resin available as MAKROLON®, reference U.S. Pat. No. 4,265,990, the disclosure of which is totally incorporated herein by reference.

This developer composition had a developer life of about 380,000 impressions, that is the $A_r$ value was stable between about −75 to about −90 microcoulombs/percent/gram.

Also, as determined by visual observation, after cleaning with the electrostatic brush, there was obtained a heavy milky haze, or film on the imaging member after the first observation thereof at 28,000 developed images, which haze persisted for about 380,000 developed images.

EXAMPLE II

A toner and developer composition was prepared by repeating the procedure of Example I with the exception that there was incorporated as an external component 0.1 weight percent of a linear polymeric alcohol, available from Petrolite Corporation, of the formula as illustrated herein with a number average molecular weight of about 700, that is where n is a number of about 48, as determined by gas chromotagraphy, and with an average particle size diameter of 8 micrometers.

The prepared developer composition was then incorporated into the same electrostatographic imaging device of Example I, and there resulted images of excellent quality, for example, no background deposits, were observed for 500,000 developed images; and further, the $A_r$ was stable between about −90 and −70 μc/percent/gram. There was observed after cleaning as in Example I a light milky slight haze on the imaging member after 100,000 developed images.

EXAMPLE III

A toner and developer composition was prepared by repeating the procedure of Example II with the exception that there was selected 0.4 percent by weight of the polymeric alcohol, available from Petrolite Corporation, of the formula as illustrated herein with a number average molecular weight of about 425, and subsequent to incorporation into the electrostatographic imaging device, the $A_r$ was stable between about −85 and −100 μc/percent/gram after 300,000 developed images. There was visually observed after cleaning on the imaging member a light milky haze after 100,000 developed images.

EXAMPLE IV

A toner and developer composition was prepared by repeating the procedure of Example I wherein there was selected 79.85 percent by weight of PLIOTONE® resin, a styrene butadiene (89/11 obtained from Goodyear Chemical Company, 3.15 percent by weight of carbon black, REGAL 330®, 16.4 percent of the magnetite MAPICO BLACK®, 0.4 percent of the charge additive distearyl dimethyl ammonium bisulfate, 0.2 percent by weight of the charge additive distearyl dimethyl ammonium methyl sulfate (DDAMS), and no polymeric alcohol (UNILIN®).

The imaging apparatus of Example I was operated with a toner dispenser delivering about 32 grams per minute of toner to the developer housing, and thereafter the toner was attracted to the latent image on the imaging member, and wherein the latent image comprised 40 percent of the imaging member area. During 500 developed images, cleaning was effected with the brush of Example I, however, at about the 501 developed image machine operation was terminated, and the layered imaging member was evaluated prior to cleaning, and a film thereon was noted. Analysis of the film on the nonimaged areas of the imaging member indicate it contained toner particles and submicron, less than 1 micron in average diameter, of magnetite particles. A sample, 1 inch by ½ inch, of the film was removed from the imaging member with clear adhesive tape, and the film with the tape was fixed to a paper substrate. The reflected optical density of the tape was 0.03 density units higher than that obtained for a clean piece of tape with no film, which optical density was determined by a MacBeth densitometer, Model RD 517®.

EXAMPLE V

A toner and developer composition was prepared by repeating the procedure of Example IV with the exception that there was incorporated into the toner as an external additive 0.2 weight percent of the linear UNILIN® polymeric alcohol of Example II, and the developer resulting was subjected to the imaging test of Example IV. A visual assessment, prior to cleaning, of the imaging member evidenced substantially no filming, and the density of the taped image on the paper substrate, as determined by the procedure of Example IV, was only 0.01 density units higher than that obtained for a clean piece of tape with no film. Reduction from 0.03 to 0.01 was a result of the cleaning of the magnetite particles from the imaging member, which cleaning resulted from the UNILIN® attracting the magnetite particles. Microscopic evaluation of the imaging member revealed that some of the density increase above that of a clear tape was due to toner particles deposited in the background areas.

Other modifications of the present invention may occur to those skilled in the art subsequent to a review of the present application. The aforementioned modifications, including equivalents thereof, are intended to be included within the scope of the present invention.

What is claimed is:

1. A process for cleaning imaging members consisting essentially of forming an electrostatic latent image on the said member, developing the image with a toner composition consisting essentially of resin particles, carbon black particles, magnetite, charge additive, or a mixture of charge additives, and a wax component comprised of an alcohol of the formula $$CH_3(CH_2)_nCH_2OH$$

wherein n is a number of from about 30 to about 300, thereafter transferring the developed image to a suitable substrate, subsequently applying to the surface of the imaging member a toner consisting essentially of resin particles, carbon black particles, magnetite, charge additive, or a mixture of charge additives and said alcohol, thereafter transferring said toner to paper whereby there is removed from the imaging members debris of magnetite by attraction to the wax component and subsequent adherence of said debris to said toner.

2. A process in accordance with claim 1 wherein the polymeric alcohol wax has a number average molecular weight of from about 475 to about 1,400.

3. A process in accordance with claim 1 wherein the polymeric alcohol wax has a number average molecular weight of from about 475 to about 750.

4. A process in accordance with claim 1 wherein the resin is comprised of styrene butadiene.

5. A process in accordance with claim 1 wherein the charge additive is selected from the group consisting of distearyl dimethyl ammonium methyl sulfate, cetyl pyridinium halides, distearyl dimethyl ammonium sulfate, and mixtures thereof.

6. A process in accordance with claim 1 wherein the imaging member is comprised of a supporting substrate, a photogenerating layer in contact therewith, and a top charge transport layer.

7. A process in accordance with claim 1 wherein the composition is applied by transporting said toner in a development apparatus across the surface of the imaging member.

8. A process in accordance with claim 7 wherein the development apparatus is a magnetic brush, and there is removed debris comprised of substantially magnetite from the imaging member by attraction to the wax component, and subsequently adherence to the toner submicron particles.

9. A process in accordance with claim 8 wherein the particles removed are comprised of resin, magnetite, charge additive, and pigment.

10. A process in accordance with claim 1 wherein subsequent to development on the imaging member the composition is removed by electrostatic transfer to paper, or by a cleaning subsystem.

11. A process in accordance with claim 9 wherein the cleaning subsystem is a brush, a web, or a blade.

12. A process in accordance with claim 1 wherein submicron particles comprised of toner resin and magnetite are removed from the imaging member by attraction to the wax component, subsequent adherence to the toner, followed by electrostatically transferring to paper or to a cleaning apparatus.

13. A process in accordance with claim 1 wherein particles containing magnetite are removed from the imaging member.

14. A process in accordance with claim 1 wherein there is selected as the resin particles a styrene butadiene with 91 percent by weight of styrene and 9 percent by weight of butadiene, pigments particles of carbon black, a charge enhancing additive of distearyl dimethyl ammonium methyl sulfate, carrier particles comprised of a steel core with a coating mixture, 0.70 percent by weight thereover, of polyvinylidene fluoride and polymethylmethacrylate, and as an external component 0.1 weight percent of said alcohol.

* * * * *